US005851147A

United States Patent [19]

Stupak et al.

[11] Patent Number: 5,851,147

[45] Date of Patent: Dec. 22, 1998

[54] PLAYER-SELECTED VARIABLE JACKPOT GAMING METHOD AND DEVICE

[76] Inventors: Bob Stupak, 1213 S. Las Vegas Blvd., Las Vegas, Nev. 89104; David Sklansky, 618 E. Carson St., Las Vegas, Nev. 89101

[21] Appl. No.: 717,383

[22] Filed: Sep. 17, 1996

[51] Int. Cl.[6] ..... A63F 1/00

[52] U.S. Cl. ..... 463/13

[58] Field of Search ..... 463/10, 11, 12, 463/13, 18, 19, 20, 21, 25, 26, 27; 273/143 R

[56] References Cited

U.S. PATENT DOCUMENTS

| | | | |
|---|---|---|---|
| 4,182,515 | 1/1980 | Nemeth . | |
| 4,448,419 | 5/1984 | Telnaes . | |
| 4,624,459 | 11/1986 | Kaufman | 273/143 R |
| 4,676,506 | 6/1987 | Crouch | 273/143 R |
| 4,711,451 | 12/1987 | Pajak . | |
| 4,856,787 | 8/1989 | Itkis . | |
| 5,042,818 | 8/1991 | Weingart | 273/292 |
| 5,092,598 | 3/1992 | Kamille . | |
| 5,123,649 | 6/1992 | Tiberio | 273/143 R |
| 5,251,897 | 10/1993 | Fulton | 463/26 |
| 5,294,120 | 3/1994 | Schultz . | |
| 5,377,973 | 1/1995 | Jones et al. . | |
| 5,382,025 | 1/1995 | Slansky et al. | 273/292 |
| 5,490,670 | 2/1996 | Hobert | 273/138 A |
| 5,494,287 | 2/1996 | Manz | 273/85 CP |
| 5,511,781 | 4/1996 | Wood et al. | 273/85 CP |
| 5,511,784 | 4/1996 | Furry et al. | 273/143 R |
| 5,513,851 | 5/1996 | Harris | 273/274 |
| 5,531,441 | 7/1996 | Dabrowski et al. | 463/13 |

OTHER PUBLICATIONS

Frome, "Winning Strategies for Video Poker," 1996, Compu–Flyers, Las Vegas, NV ISBN 0–9623766–3–9, pp. 6–17 &62–63.

Sklansky, "Sklansky on Poker," 1994, Two Plus Two Publishing, Las Vegas, NV, ISBN 1–880685–06–X.

Sklansky, "The Theory of Poker," Two Plus Two Publishing, Las Vegas, NV ISBN 1–880685–00–0.

Sklansky, "Getting the Best of It," 1993, Two Plus Two Publishing, Las Vegas, NV, ISBN 1–880685–04–3.

Malmuth, "Fundamentals of Video Poker," 1992, Two Plus Two Publishing, Las Vegas, NV ISBN 1–880685–12–4.

Buckley, Industry Seeks Next Generation Slot Machine, USA Today, May 20. 1996, p. 1, col. 3.

*Primary Examiner*—George Manuel
*Attorney, Agent, or Firm*—Quirk & Tratos

[57] ABSTRACT

An electronic gaming method and device in which the player is able to choose from among a variety of jackpots and associated pay-out schedules varying from low to high jackpot amounts. Best suited to video poker machines, the invention permits the player to choose between higher Royal Flush jackpots tied to lower pay-outs for lower-ranked hands, and lower Royal Flush jackpots tied to higher pay-outs for more frequently achieved lower-ranked hands. In this way, a quarter ($0.25) video poker machine may have a jackpot for a "Royal Flush" ranging up to $25,000 (on the basis of a $1.25 bet) without the need to accumulate funds in a "progressive" jackpot or to interconnect groups of machines. Special jackpots can also be awarded for "Sequential," "Pat" or "Pat Sequential" Royal Flushes allowing jackpots up to $1,000,000 on quarter ($0.25) video poker machines without the need for the player to choose between machines and/or locations to locate desired jackpot amounts.

9 Claims, 7 Drawing Sheets

FIG. 5
SAMPLE QUARTER (25¢) VIDEO POKER PAY-OUT SCHEDULE

| Royal Flush Jackpot (5 coins bet)* 102 | $1,000 104 | $2,000 110a | $3,000 | $5,000 112 | $10,000 134 | $25,000 106 |
|---|---|---|---|---|---|---|
| Royal Flush (up to 4 coins bet) | $50 (200)** | $100 (400) 110b | 150 (600) | 250 (1000) | 500 (2000) | — |
| Straight Flush | $12.50 (50) | $12.50 (50) | $12.50 (50) | $12.50 (50) | $12.50 (50) | — |
| 4 of a Kind | $6.25 (25) | $6.25 (25) | $6.25 (25) | $6.25 (25) | $6.25 (25) | — |
| Full House | $2.25 (9) | $2.00 (8) 126 | $1.50 (6) | $2.50 (10) 128 | $2.25 (9) | — |
| Flush | $1.50 (6) | $1.25 (5) 122 | $1.25 (5) | $1.75 (7) 124 | $1.50 (6) | — |
| Straight 108 | $1.00 (4) | $1.00 (4) 109 | $1.00 (4) | $1.25 (5) 112 | $1.00 (4) | — 111 |
| 3 of a Kind | $.75 (3) | $.75 (3) | $.75 (3) | $.75 (3) | $.75 (3) | — |
| 2 Pair 114 | $.50 (2) | $.50 (2) 116 | $.50 (2) | $.25 (1) 118 | $.50 (2) | — |
| Jacks or Better*** | $.25 (1) | $.25 (1) 132 | $.25 (1) 132 | $.25 (1) 132 | — 130 | — |

* Royal flush jackpot requires $1.25 (5 quarters) bet per game.
** Numbers in parentheses are numbers of quarters dispensed per quarter bet, up to 5, except the Royal Flush where the maximum bet is made.
*** Pair of Jacks, Queen, King or Ace.

FIG. 6
SAMPLE QUARTER (25¢) VIDEO POKER PAY-OUT SCHEDULE WITH "PAT" AND SEQUENTIAL ROYAL FLUSHES

| Royal Flush Jackpot (5 coins bet)* | PAT ROYAL FLUSH $10,000 202 | SEQUENTIAL ROYAL FLUSH $100,000 204 | PAT SEQUENTIAL ROYAL FLUSH $1,000,000 206 |
|---|---|---|---|
| Royal Flush (up to 4 coins bet) | $1,000 (200) | $1,000 (200) | $1,000 (200) |
| Straight Flush | $12.50 (50) | $12.50 (50) | $12.50 (50) |
| 4 of a Kind | $6.25 (25) | $6.25 (25) | $6.25 (25) |
| Full House | $2.00 (8) | $2.00 (8) | $2.00 (8) |
| Flush | $1.25 (5) | $1.25 (5) | $1.25 (5) |
| Straight | $1.00 (4) | $1.00 (4) | $1.00 (4) |
| 3 of a Kind | $.75 (3) | $.75 (3) | $.75 (3) |
| 2 Pair | .50 (2) | .50 (2) | .50 (2) |
| Jacks or Better*** | .25 (1) | .25 (1) | .25 (1) |

* Royal flush jackpot requires $1.25 (5 quarters) bet per game.
** Numbers in parentheses are numbers of quarters dispensed per quarter bet, up to 5.
*** Pair of Jacks, Queen, King or Ace.

PLAYER-SELECTED VARIABLE JACKPOT GAMING METHOD AND DEVICE

FIELD OF THE INVENTION

The invention relates to the field of gaming or gambling, and more particularly, to gaming devices and games that pay varying amounts depending on which randomized events and/or player choices occur during play, especially video poker.

BACKGROUND OF THE INVENTION

Gambling or gaming machines are well known. Earliest embodiments took the form of mechanically-operated devices such as "slot machines" incorporating a series of spinning wheels, each bearing a sequence of symbols along its periphery indicating stop positions. Depending on which sequence of symbols randomly appeared in the viewing window along a win line, various prizes, credits or cash were awarded. Commonly, the appearance of a single symbol in a certain location (such as "cherries" on the first reel) might award a small amount, perhaps less than the amount bet by the player. A pair of the same symbol would pay slightly more. Three of that symbol would pay higher still. However, in the same device, the appearance of a different symbol such as a "7" or bar might not pay anything for a single or pair, but three "7"s or "bars" might constitute a "jackpot" awarding the highest prize. The overall pay-out rate, and, thus, the house's profit or "take" is determined by a set of "pay-out tables," also known as "pay-out schedules." Modernly, the highest jackpot can only be achieved by wagering the maximum number of credits for each play, usually three to five credits. (A credit may take the form of a coin, token or electronically-recorded account entry. For clarity, all such wagers and awards will be referred as "credits" herein). The highest jackpot is usually proportionally exaggerated from jackpots which can be won by betting less than the highest number of credits allowed per play. For example, a single credit bet might yield a highest jackpot of 100 credits. Two credits bet might yield a highest jackpot possible of 200 credits. However, three credits bet (in a three credit maximum device) might yield a possible jackpot of 1000 credits.

More modernly, gaming machines are controlled by microprocessors, the devices being either mechanical spinning reels or animated displays of reel, cards, Keno boards and the like. The emergence of such electronic devices has opened a vast set of possibilities to gaming device designers. One such innovation has been to interconnect banks of machines, both locally and over broad geographic areas, with a small percentage of each wager being cumulatively added to a centralized ever-growing jackpot. Such an arrangement is known as a multi-link progressive jackpot. One state-wide progressive jackpot is the Megabucks® program operated by International Gaming Technology throughout the State of Nevada.

The use of microprocessors to control gaming machines have also permitted adjustments in the odds of achieving any particular combination or game outcome. For example, U.S. Pat. No. 4,448,419 describes a mechanical reel slot machine controlled by a microprocessor in such a way as to control and vary the odds of achieving any particular combination of symbols through the use of a random number generator picking numbers representing stop positions, each such stop position represented by one or more numbers so as to control the frequency of occurrence. The scheme creates a "virtual reel" even though a physical reel is used to display the game outcome symbols. Similarly U.S. Pat. No. 4,711,451 describes a gaming machine using a set of mechanical spinning reels controlled by a microprocessor and a reel mapping scheme permitting a single machine to act as a standard gaming device, a "multiple stop" gaming device or a "virtual reel" gaming device, thus saving software development costs. The '451 patent describes a "multiple stop" machine as one in which a single reel contains more than one of a particular symbol. The '451 patent defines a virtual reel machine in which stop positions are controlled by random numbers but a number of stop positions have multiple random numbers associated with them. Some devices offer multiple games which can be played concurrently. (See U.S. Pat. No. 4,856,787).

Other innovations have been the expansion of the panoply of games played on gaming machines. For example, commonly, the card game "Poker" (and variations thereon) is played on electronic video devices known as "video poker machines." While it is technically possible for a video poker machine to vary the odds of drawing certain cards or achieving certain combinations of cards, such machines are prohibited by all known gaming regulations, and, even if allowed, would be shunned by players. Therefore, universally video poker machines faithfully simulate cards randomly dealt from a 52 card deck (except in the "Multi-Deck Poker Game" described in U.S. Pat. No. 5,042,818). In order to control the overall pay-out (and, thus, the house's "take" or profit) in a video poker machine, the pay-out schedules for each machine must be constructed such that the disproportionately high jackpot pay-out is compensated for by concomitantly lower intermediate pay-outs.

Because "virtual reel" slot machines obscure the true probability of achieving certain combinations, players tend to choose slot machines according to the size of the jackpots offered without an appreciation of how truly low the probability is of hitting a large jackpot. For example, the odds of achieving a giant jackpot in a Megabucks® machine (often in the tens of millions of dollars) may be infinitesimally low, but, to the player, it does not seem any lower than obtaining other symbol combinations. In other words, in virtual reel slot machines, high jackpots may be offered which have a very low probability of being achieved, but with the player often essentially unaware of the odds. Video poker is quite different: the size of the jackpot (Royal Flush with maximum bet) must be a function of the pay-out amounts for lesser winning hands such as "Two Pair" or "Three of a Kind," because the probability of drawing a particular card or achieving a certain winning hand must always be the same. (It should be noted that while the probability of drawing a particular card or combination of cards remains mathematically constant, player choices as to which cards to "hold" and which to discard will vary the overall frequency of particular hands being achieved due to varying the rewards for achieving them).

Thus, in video poker machines, when the Royal Flush jackpot is relatively high, the pay-out amounts for lesser card combinations must be reduced. Consequently, players tend to balance their desire to play, and decide which machines to play, by choosing between the low probability of obtaining the highest jackpot and the higher probability of obtaining the lower intermediate pay-outs. Depending on the player, he or she may choose one device over another based on the perceived balance of frequency between receiving small psychological-reinforcing "wins" versus infrequent large jackpots. He or she may choose a machine with a very large Royal Flush jackpot but paying small amounts for a "Full House," over a machine with a smaller Royal Flush jackpot but higher pay-outs for the same "Full House," although in the long run his "rate" of winning or losing will be the same. The disadvantage is that if a player chooses a machine with a large tempting Royal Flush jackpot, he or she may lose interest quickly since the size of smaller pay-outs must be concomitantly low. Conversely, a player may not be attracted to a machine with slightly larger intermediate pay-outs (e.g. "Full House" or "2 Pair") if the size of the Royal Flush jackpot is small. Previous approaches to overcoming this limitation have included progressively increasing pay-outs as a single machine is played (U.S. Pat. No. 5,123,649) and randomized choice of pay-out tables with each play of the game (U.S. Pat. Nos. 5,494,287 and 4,624,459). The '649 invention teaches a machine in which the pay-out amounts increment with the occurrence of certain events, and reset on the occurrence of other events. The '649 invention is designed to cause the player to feel his initial bets were "investments" toward the ever-increasing pay-out as it grows on his or her machine. However, the '649 patent also discloses a reset circuit to cancel the higher pay-outs on the occurrence of an event such as a random game outcome or the passage of a time limit. Whether by virtue of the cancel circuit or by the odds of the game, a player will rarely achieve a progressive jackpot and may become frustrated as he or she wins small intermediate awards, forcing the player down to the lower pay schedules.

The '287 invention presents the player with the possibility of winning intermediate awards or a jackpot, but the pay-out schedule is randomly selected after a bet is made. Since intermittent wins will, a percentage of the time, be paid according to pay-schedules which are less than the highest pay-table, the player may begin to feel he was deprived of his "big win" since he obtained the necessary combinations of symbols but was not permitted to win the biggest prize (due to the random choice of a lower than maximum pay-table). Similarly, the '459 patent discloses an invention wherein "multiple pay-outs" (those paid based on multiple credits or coins being bet on a single game) are randomly chosen for each game. Players may become distrustful of such devices since the choice of the multiple pay-outs or jackpots is made by the gaming device, albeit a random choice, but the gaming device nevertheless.

In many locations governmental regulations govern the minimum over-all pay-outs for slot machines because the use of digital technology has permitted the design of slot devices having "virtual reels," depriving the player of a true idea of the odds of a particular symbol appearing on the "win line" with each game. Early mechanical slot machines had a finite number of symbols on a wheel (usually 20 to 24) and the odds of each symbol appearing was relatively easily discernible (namely, the number of times the symbol appeared on a reel, out of the total number of symbols on a reel). Modern technology has allowed machines to appear as if they are reels with a similar number of symbols with an equal probability of being hit—but, in actuality, may vary the probability of a particular symbol appearing on the win-line without limitation.

By contrast, card games (e.g. Draw Poker) played on electronic video devices normally closely simulate an actual card game, including the number of cards in a deck. This provides a simulated game with the same odds of winning a particular hand as if played with actual playing cards. When randomized (shuffled), a dealt hand always has the same odds of achieving certain combinations. For example, in a "Jacks or Better" Draw Poker machine (paying a prize for a pair of Jacks, Queens, Kings or Aces), the approximate probabilities of obtaining any of the following winning hands before the draw (with the initially-dealt cards) is as follows:

| | |
|---|---|
| Royal Flush | .00015% (.0000015) |
| Straight Flush | .0014% (.000014) |
| Four of a Kind | .03% (.0003) |
| Full House | .15% (.0015) |
| Flush | .2% (.002) |
| Straight | .4% (.004) |
| Three of a Kind | 2.0% (.02) |
| Two Pair | 5.0% (.05) |
| Jacks or Better | 12.8% (.128) |

However, video poker games provide the opportunity to "hold" or "discard" any number of the player's initially-dealt cards and draw from the remaining cards in the randomized deck. Therefore, the odds of obtaining a winning hand on the draw is dependent on the cards initially dealt, and thus removed from the finite number of cards in the deck. The player can therefore calculate, or make an approximation, of the odds of drawing a winning hand depending on which cards he or she decides to retain or discard.

For example, if the player is dealt three Sevens, a Queen and a Deuce, he or she will normally discard the Queen and the Deuce and draw two replacement cards. The probability of drawing a Seven to obtain Four of a Kind is 0.043 or 4.3% (2/47). The player may also achieve a Full House by drawing a pair, the probability for which is approximately 0.061 or 6.1% $((4/47\times3/46\times10)+(3/47\times2/46\times2))$. Thus the odds of improving the hand from a Three of a Kind to anything better is the sum of the foregoing probabilities or 0.104 or 10.4%.

Another example would be that if a player drew four of the five cards necessary for a Royal Flush, the probability of drawing the single card needed to complete the Royal Flush would be 1/47 (0.02 or 2%).

By balancing an idea of the odds of drawing certain cards to complete a certain combination versus the award in the pay-schedule for that combination, the player makes a decision each game as to which cards to play and which cards to discard.

For example, if, after betting 5 credits ($1.25 in a quarter machine), assume the player is dealt the following first hand:

Ace of Hearts
King of Hearts
King of Spades
Ten of Hearts
Three of Clubs.

The player has two rational choices:

(1) He or she may hold the Kings and discard the remainder in the hopes of getting Two Pair or better. Two Pair typically pays two credits per credit bet with a probability of approximately 0.17. There is also a chance of getting "Four of a Kind" (four Kings) with a probability of 0.003 (typically paying 25 credits per credit bet), Three of a Kind with a probability of approximately 0.11 (typically paying 3 credits per credit bet), or a "Full House" by either drawing three of a kind in the next draw, or drawing another King and any other pair with a probability of approximately 0.01 (typically paying 9 credits per credit bet).

(2) He or she may hold the Ace of Hearts, King of Hearts and Ten of Hearts in the hopes of getting a Flush or a Royal Flush. To get a Flush (all cards of one suit) the player must draw two more Hearts cards with a probability of 0.042 (10/47×9/46) typically paying six credits per credit bet. However, to get a Royal Flush would require the player to draw the Jack of Hearts and Queen of Hearts, with a 0.0009 probability (2/47×1/46) paying the Royal Flush Jackpot (if the maximum bet is made).

In the above example, if the Royal Flush jackpot is low (below approximately $1700 in a 25¢ machine), then the best strategy would be to hold the Kings. However, if the Royal Flush Jackpot is relatively high (approximately $1700 and above in a 25¢ machine), then the best strategy would be to go for the Royal Flush.

If a Royal-Flush jackpot is nominal, those skilled in the art will know from experience that a given device will hit it once in approximately 40,000 games. If the jackpot for a Royal Flush is very high (for example, 20,000 credits per credit bet based on a 5-credit minimum bet), it will be hit approximately once in 30,000 games because, when given the opportunity to hold or discard cards, players will more frequently forego the higher likelihood of achieving smaller prizes in the hope of hitting the inflated jackpot. If players never tried to achieve a lesser hand than a Royal Flush, it would be hit once in approximately 23,000 games.

BRIEF SUMMARY OF THE INVENTION

It is therefore an object of the present invention to provide a gaming device wherein the player has a choice of jackpot amounts.

It is a further object of the present invention to provide a gaming device wherein the player of such a device can choose the size of the jackpot by picking between a series of pay-out schedules or by initiating a calculation to generate pay-out schedules based on the odds of achieving various combinations of symbols and the return desired by the operator of the gaming device (e.g. a casino).

It is a further object if the present invention to permit the award of a greater range of jackpots.

It is a further object of the present invention to provide a method for dynamically calculating and displaying pay-tables from which the play may choose.

It is a further object of the present invention to provide a means for providing a broad range of jackpot amounts from nominal to extremely high, without the need for the player to "shop around" for different machines paying varying jackpot amounts.

It is a further object of the present invention to provide a means for displaying a multiplicity of candidate jackpots and associated pay-tables from which the player may choose the one he or she wishes to use for each game.

It is a further object of the present invention to provide the player with a way to quickly choose between available jackpots and/or pay-out schedules.

It is a further object of the present invention to provide a gaming machine which will give the player greater flexibility in the range and choice of games available to him or her without the need to play different machines in different locations.

It is a further object of the present invention to provide the owner/operator of gaming machines with a means to obtain and retain a higher percentage of the gaming public by offering a more flexible and varied gaming experience.

In accordance with these and other objects of the invention, one embodiment of the invention is an electronic gaming device having a variety of jackpots displayed, from which the player may choose prior to placing a bet or initiating a game. The jackpots are displayed on or near the machine. The device displays a range of potential jackpots with concomitant ranges of intermediate or lesser prizes. A means of indicating the jackpot, and associated pay-table chosen is provided. This may take the form of an indicator symbol such as a number on the video screen corresponding to a labeled jackpot on the jackpot display, a highlighted back-lit display or a video display of the jackpot and associated pay-table.

In another embodiment of the invention, each discrete pay-table is electronically recorded in a memory device component of the gaming machine, such as read-only memory (ROM). Well-known circuitry and computer software programs compare the chosen pay-out schedule with the randomized outcome of a particular game to determine the amount to award the player. The award or "winnings," if any, are dispensed to the player or credited to his or her electronic account.

In another embodiment of the invention, pay-schedules are calculated for each game based on an algorithm intended to generate an approximately constant overall pay-out regardless of the size of the largest jackpot chosen by the player (within limits).

In order to provide even greater maximum jackpots in Poker video games, a super-high jackpot may be awarded for a "Pat" Royal Flush, meaning a Royal Flush dealt in the initial hand. Since the odds of obtaining such a hand are approximately 0.0000015 (1 chance in 650,000)), the jackpot for such a pat hand can be quite high without affecting the overall pay-out of the machine Therefore, another embodiment of the present invention includes a special high reward for achieving a certain winning hand on the initially-dealt hands, for example, a Royal Flush.

Similarly, in a video Poker game, a super-high jackpot for a "sequential" Royal Flush (the cards appearing in sequence on the screen) can be awarded since the probability of obtaining such a hand, even after the draw is approximately 1 in 5 million. Therefore, in another embodiment of the present invention, one or more of the available jackpots is a Sequential Royal Flush. Even higher Royal Flush jackpots can be offered if a numerically sequential Royal Flush is dealt in the initial deal (a "Pat" Sequential Royal Flush). The odds of obtaining such a hand are approximately 1 in 80 million. Therefore, an enormous jackpot can be offered for such a hand with only a small adjustment to the balance of the pay-out schedule. Thus, another embodiment of the present invention incorporates a user-selected jackpot which is achieved only by obtaining a Sequential Pat Royal Flush.

The present invention, namely providing the player with the ability to chose his or her own jackpot, is also applicable to other games such as, without limitation, races (live, recorded or simulated), Pull-Tabs, dice games (such as Craps), Black-Jack (Twenty One), other card games, and sporting contests.

BRIEF DESCRIPTION OF THE DRAWINGS

FIG. 5 is a sample set of pay-out schedules for a quarter poker machine according to the present invention offering a range of royal flush jackpots from $1,000 to $25,000.

FIG. 6 is a sample set of pay-out schedules for a form of the present invention offering super high jackpots for a "Pat Royal Flush," "Sequential Royal Flush," and a "Pat Sequential Royal Flush."

DETAILED DESCRIPTION OF THE INVENTION

Figure 1:
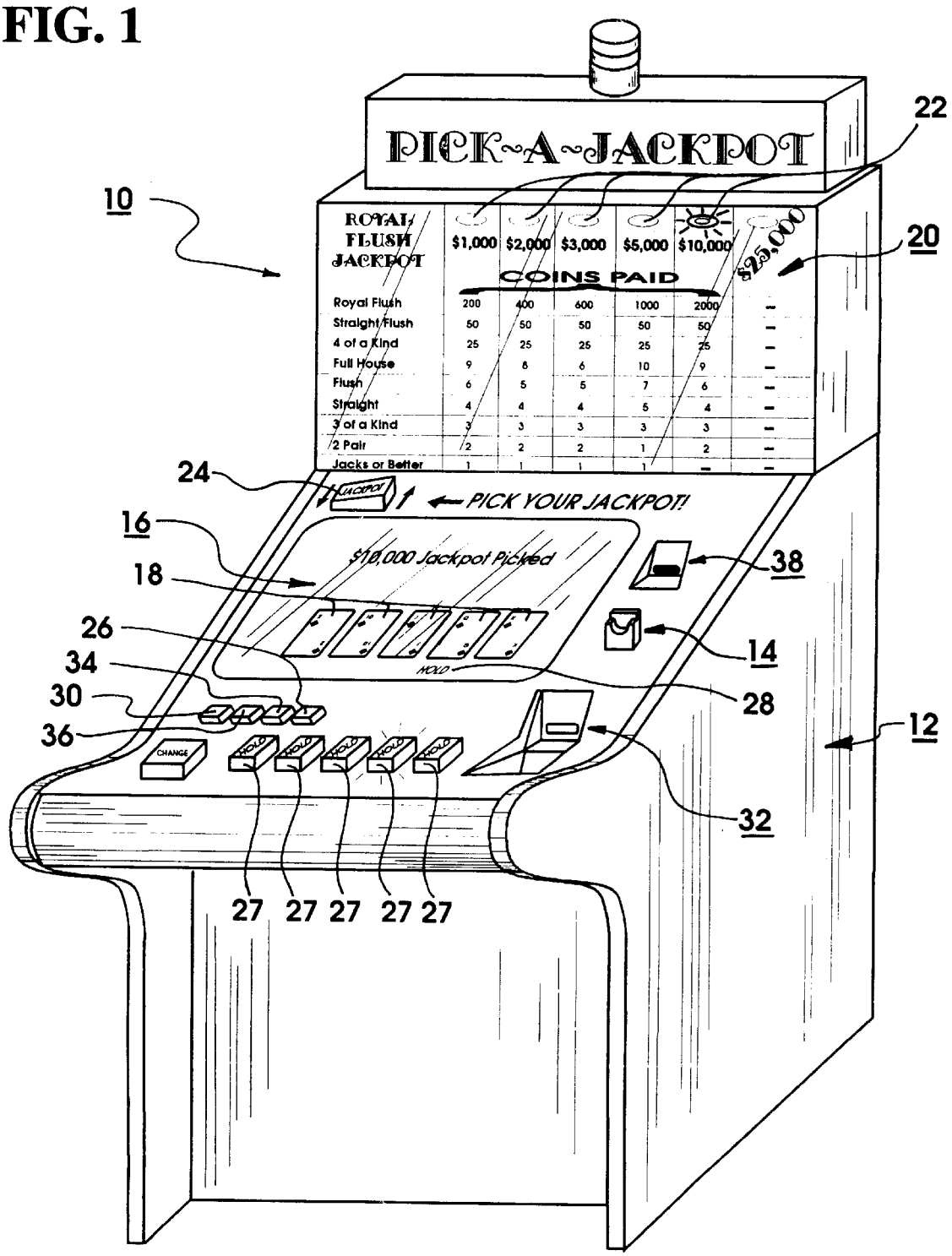
FIG. 1 is a perspective view of a gaming device in accordance with the present invention.

FIG. 1 illustrates a video poker machine 10 in accordance with the invention. The video poker machine 10 includes a housing 12, a coin input slot 14 into which a player inserts a coin, a video display 16 showing cards 18 drawn from a virtual deck of cards, a jackpot display 20 showing available jackpots and associated pay-out schedules, indicator lights 22 showing the currently active jackpot chosen by the player by pressing a jackpot selector button 24. The game is initiated by inserting one or more coins (up to a maximum, usually 5) into the coin input slot 14 then pressing the "Deal/Draw" button 26. The internal digital computer program randomizes (shuffles) the virtual deck of cards and displays five random cards 18 on the video display 16. The player then has the choice of holding or discarding one or more of the cards displayed by pressing one or more "Hold" buttons 27 each located below a displayed card 18. Pressing a Hold button causes the word "Hold" 28 to appear adjacent to (or superimposed over) the associated card 18 on the video display 16. Pressing the same Hold button 26 causes the word "Hold" 28 to be removed from the associated card 18 on the video display 16. Once the player has decided which cards to "hold" and which to discard, he or she presses the "Deal/Draw" button 26.

If the player has not pressed a "Hold" button 27 below one or more of the displayed cards 18, the internal computer program picks replacement cards from the remaining available cards in the deck and displays them in place of the discarded cards on the video display 16. ("Discarded" cards are the cards without the word "Hold" 28 appearing on the video screen 16 adjacent to, or superimposed over, the card 18). The internal computer software program then compares the combination of cards appearing on the video display 16 to known winning combination stored in the computer's memory. If there is a winning combination according to the rules of the game, for example "Three of A Kind," the pay-out schedule associated with the jackpot chosen by the player is used by the machine to determine the prize, if any. The player may then obtain his or her winnings by pressing the "Cash-Out" button 30 and the machine will dispense the players winnings (in addition to any credit remaining from previous games) in the coin hopper 32. If the "Cash-Out" button 30 is not pressed, any winnings remain as a credit and may be wagered in the next game. If there are enough credits, the player may bet the maximum allowed per game by pressing the "Bet Maximum" button 34 or may bet in single credit increments by pressing the "Bet One Credit" button 36 repeatedly until the number of credits bet is the desired number. The player may then press the "Deal/Draw Button" 26 (although the cards will automatically be dealt if the maximum bet allowed is made either by pressing the "Bet Maximum" button 34, by inserting the maximum bet amount in the coin input slot 14 or by choosing the maximum bet by repeatedly pressing the "Bet One Credit" button 36). A paper currency input device 38 may also be provided which functions equivalently to the coin input slot 14 and is well-known to those experienced in the art. Additionally, the machine may be linked to a central credit account database such as a casino account or even a bank account so that credits may be played from the player's account.

Figure 2:
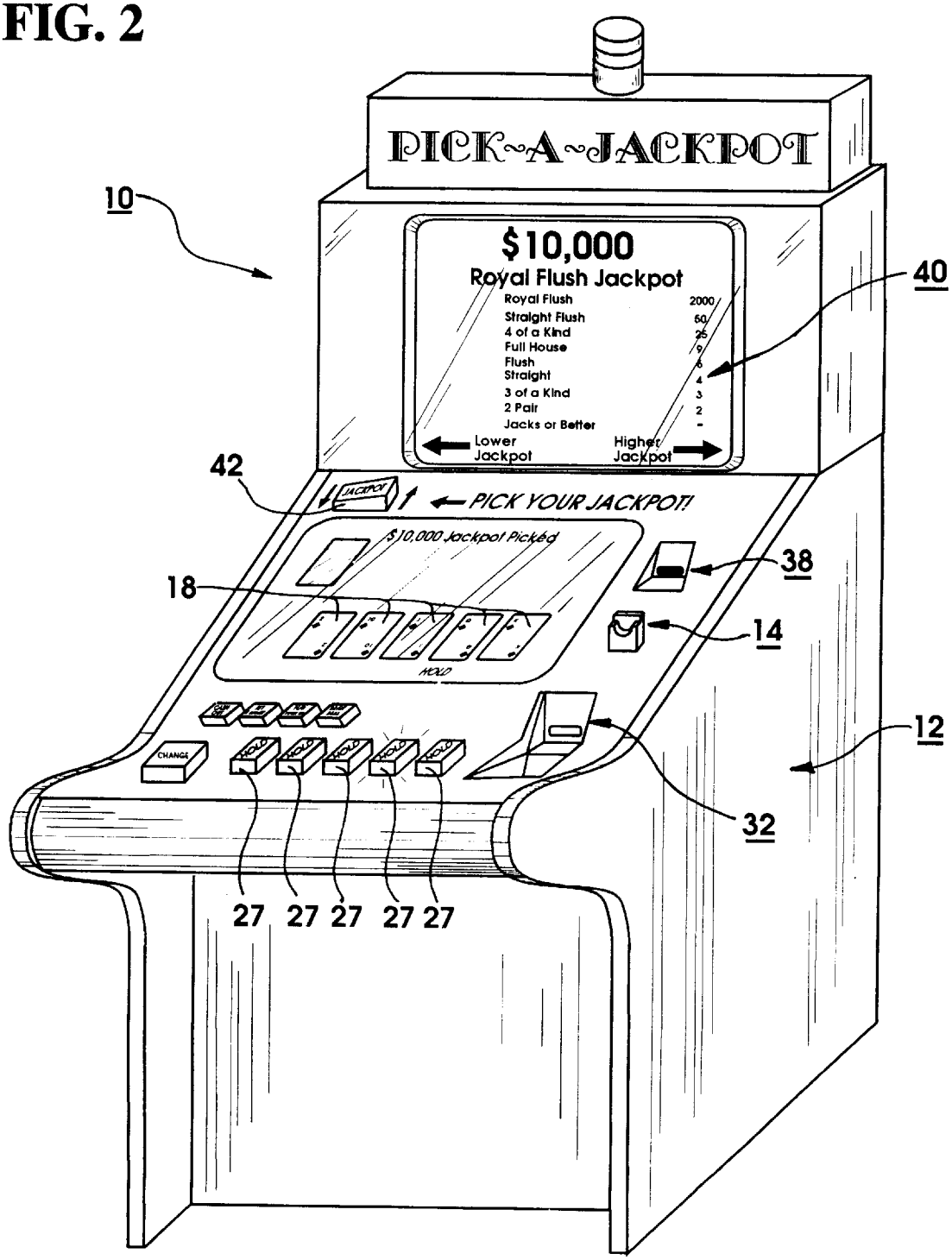
FIG. 2 is a perspective view of an alternative embodiment of the present invention showing a player-scanable display of available jackpots and associated pay-out schedules.

An alternative embodiment is illustrated in FIG. 2. Here, the available jackpots and associated pay-out schedules are displayed on a second video display 40 and the player can view sequentially (scan) the available jackpots using the "Pick Jackpot" button 42.

Figure 3:
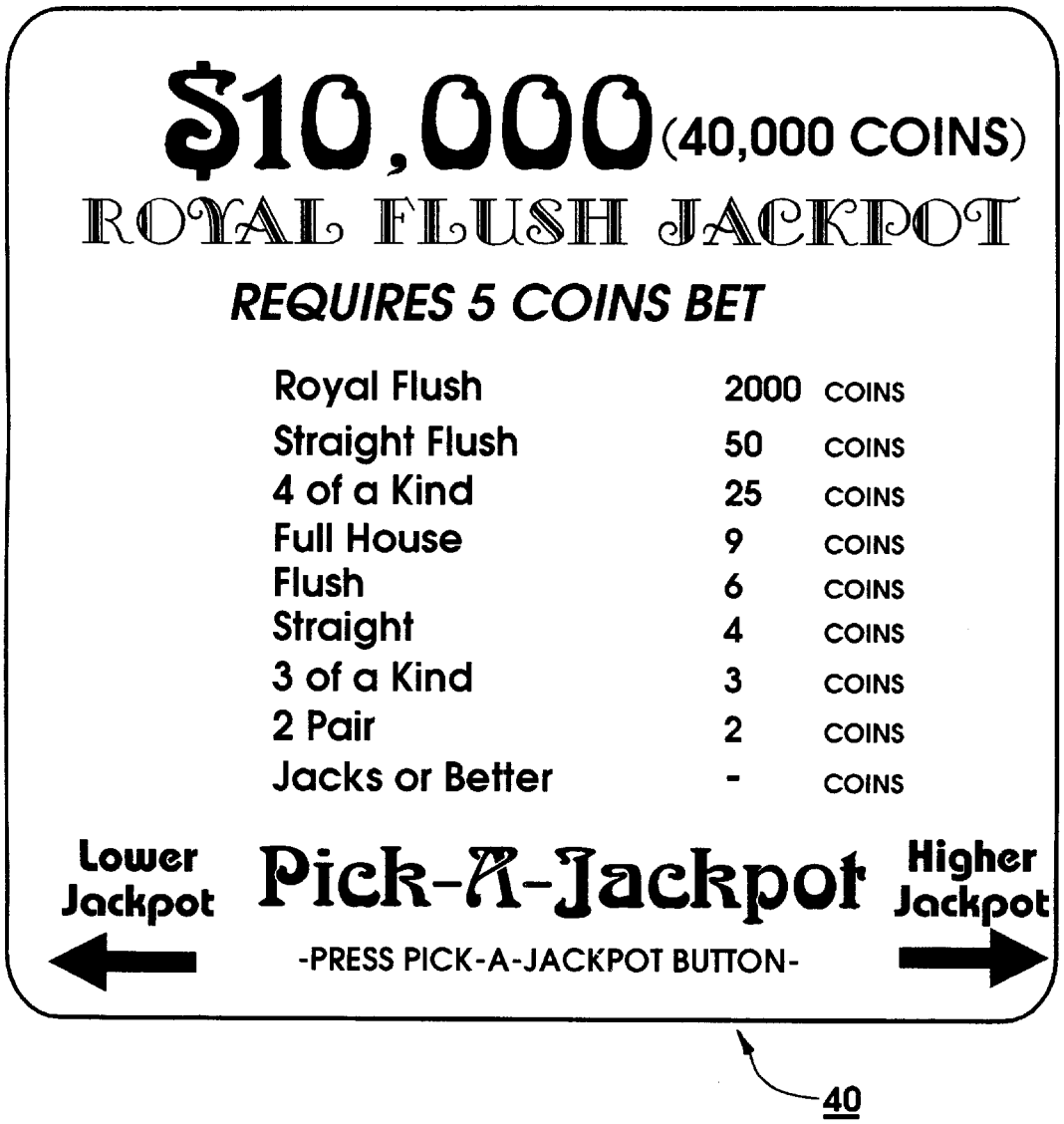
FIG. 3 is an alternative embodiment of the present invention showing an example jackpot with associated pay-out schedule display on the second video display.

An example jackpot with associated pay-out schedule displayed on the second video display 40 is illustrated in FIG. 3 showing a display for a $10,000 jackpot using a possible pay-out schedule. By pressing the jackpot choice button 42, the player may see each jackpot and associated pay-out schedule in sequence to assist in deciding on which one to use for each game, or for a series of games.

Figure 4:
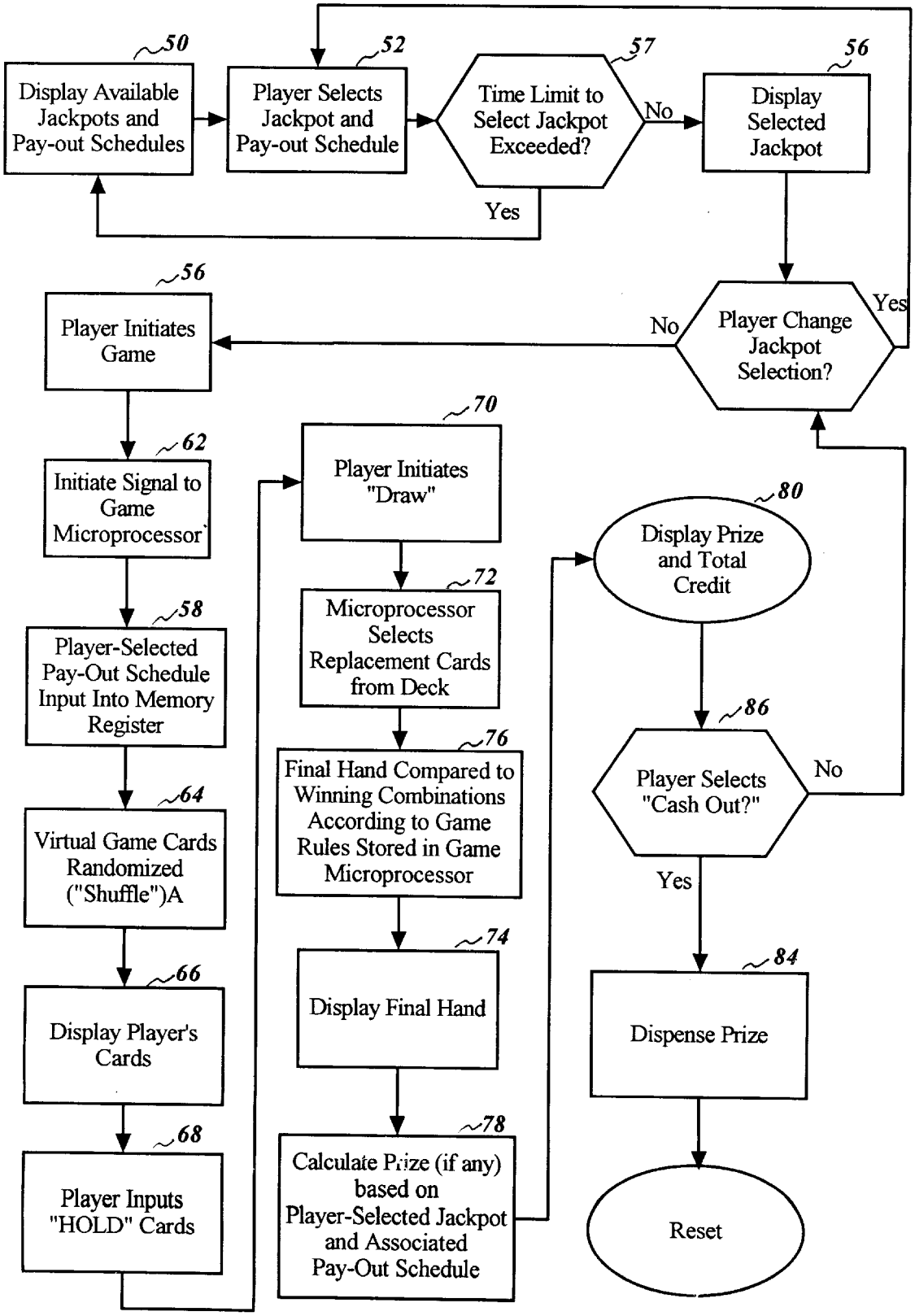
FIG. 4 is a flow chart illustrating the sequence of operations in the video poker embodiment of the present invention.

Operation of the present invention may best be illustrated by reference to FIG. 4, a flow chart of operations. The candidate pay-out schedules are displayed 50. From the displayed jackpots, the player chooses the one he or she wishes to play 52. The chosen jackpot pay-out schedule is displayed 54. The player then is able to initiate the game 56 or pick another 52. If no confirmation is input after a pre-set time interval 57, the game returns to its initial state and displays available jackpots 50 waiting for a player to initiate a game. Once the game is initiated 56, the pay-out schedule associated with the player-selected jackpot is input into the memory of the game microprocessor 58. The game initiation 56 confirms the choice of pay-out schedules. Game initiation 56 may take the form of inputting coins, currency or tokens, pressing a button, touching a display screen or speaking a command.

The player input to initiate the game sends a signal to the game microprocessor 62 which randomizes a "virtual" deck of cards 64 and displays the player's initial hand 66. The player then decides which, if any, cards in the displayed initial hand he or she wishes to "hold" 68. The player then initiates a draw 70 in which the cards not "held" are replaced with new cards from the remaining "virtual" deck 72 and the final player's hand is displayed 74. The final player hand is compared to winning combinations of cards according to the rules of the particular game 76. If there are any winning combinations of cards in the player's final hands, the prize value is determined from the player selected pay-out schedule 78 stored in memory 58 and displayed 80. If there is a credit the player is given the opportunity to "cash out" 82 (i.e. have the credit dispensed 84) or keep the credit in the machine and apply it to the next game.

The player then again has the option of choosing a new jackpot and associated pay-out schedule 86 or keeping the previously played jackpot and re-initiating the game 56.

The last-used jackpot and associated pay-out schedule 58 may be retained as the "selected" schedule for the next game until a preset time interval has passed, after which a "default" pay-out schedule may automatically be input into memory 58 for the next game, or, the last used jackpot amount may be retained indefinitely.

Reference to FIG. 5 will help illustrate how the objectives of the present invention may be achieved. It should be kept in mind that an objective of the present invention is to permit the player to choose from a range of possible Royal Flush jackpots 102 while the house's overall take remains nearly constant. FIG. 5 illustrates an example pay-out schedule allowing jackpots for achieving a Royal Flush with a five quarter bet ranging from $1,000 104 to $25,000 106. By making adjustments to prizes awarded for less than Royal Flush wins, the overall pay-out for this example pay-out schedule remains nearly constant regardless of which Royal Flush Jackpot 102 is chosen by the player. For example, if a player chooses a $2,000 jackpot and bets 5 quarters (the maximum allowed in this example) and, at the end of the game holds a "Straight" 108, he or she will win $5.00 ($1.00 per quarter bet) 109. If, however, the player holds a Royal Flush 102 (10, Jack, Queen, King and Ace, of the same suit), he or she will win $2,000 110*a*. Had the player bet only 4 quarters, he or she would not qualify for the jackpot 104, and would instead receive $400 110*b* ($200 per coin bet). Alternatively, if the player had selected the $25,000 jackpot 106, he or she would win nothing for the straight 111, or any other hand for that matter (except the Royal Flush). Similarly, had the player chosen the $5,000 jackpot 112, bet 5 quarters, and obtained a Straight 108, he or she would have won $6.25 ($1.25 per coin bet) 112. In the above example, the player would not be permitted to pick the $25,000 jackpot 106 unless he or she played the maximum number of credits permitted (here, $1.25).

The overall take for the house remains relatively constant, approximately 1% to 3% (except for the $25,000 Royal Flush jackpot which is as high as 10%) because of the adjustments to the pay-out schedule for each chosen jackpot. For example, the probability of obtaining Two Pair 114 in a given game are approximately 13% (assuming no wild cards and the player is playing reasonably). Therefore, a player will achieve Two Pair 114 approximately once in every 8 hands. Conversely, a Royal Flush 102 will be achieved only once in approximately 40,000 hands (30,000 or less if the jackpot is raised disproportionately and the player will try for it more frequently). Therefore, without affecting the overall "take" of the house, by changing the per-coin prize for Two Pair from a $0.50 116 to a $0.25 118, the house is able to increase the prize for a Straight from $1.00 per coin bet 109 to $1.25 per coin bet 112, for a Flush from $1.25 per coin bet 122 to $1.75 per coin bet 124, for a Full House from $2.00 per coin bet 126 to $2.50 per coin bet 128 and for a Royal Flush Jackpot from $2,000 (total) 104 to $5,000 (total) 112, without any changes to other card combinations. Similarly, since the probability of achieving "Jacks or Better" (a pair of Jacks, Queens, Kings or Aces) is relatively high (approximately 20%), and a typical "Jacks or Better" machine pays pack the amount bet for achieving Jacks or better 132. by leaving all prizes unchanged and eliminating any prize for Jacks or Better, the Royal Flush Jackpot can be increased from $1,000 (total) 104 to $10,000 (total) 134 without significantly affecting the overall take of the house.

It should be noted that FIG. 5 is just one example of a pay-schedule constructed to permit a variety of player-selected jackpots and is in no way intended to limit the scope of possible variations on the pay schedules. Persons skilled in the art of constructing pay-out schedules will immediately see the possible variations enabling one to achieve constant overall pay-outs while varying the jackpot amounts. Nor is the above table intended to limit the scope to Poker machines. The same principal can readily be applied to other gaming machines such as slots.

FIG. 6 illustrates three add-on super jackpot examples which can be incorporated into the present invention. The approach illustrated in FIG. 6 permits the awarding of extraordinarily high jackpots by making the highest jackpots achievable only by sequential 202 hands or "pat" 204 hands. The probability of achieving a sequential royal flush (even the opportunity to discard and draw cards once) are 1/5,000,000 (0.0000002). As discussed above, probability of achieving a "pat" Royal Flush is 0.0000015. The probability of receiving a "Pat Sequential Royal Flush" is 1/80,000,000 (0.0000000125). Therefore, special Royal Flush Jackpots can be awarded for Pat, Sequential and/or Pat-Sequential Royal Flushes of approximately $10,000, $100,000 and $1,000,000 respectively, without altering the overall house "take" significantly. The three columns in FIG. 6 would simply be appended onto the pay-out schedule in FIG. 5. The player could choose one of the jackpots and associated pay table illustrated in FIG. 6 or any of the other jackpots and associated pay-out tables illustrated in FIG. 5.

The pay-out schedule in FIG. 6 has an overall house take of approximately 1% to 3%.

Figure 7:
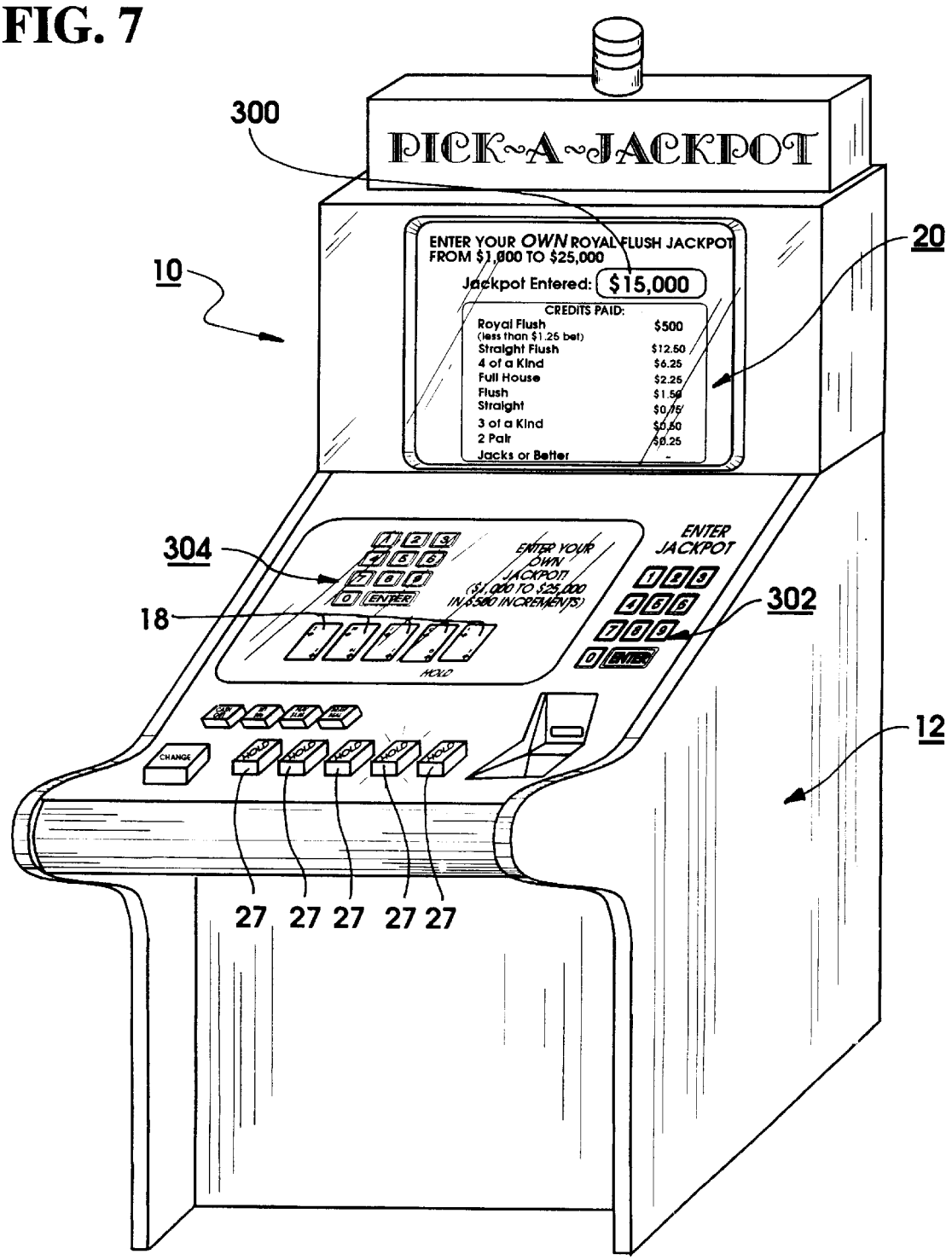
FIG. 7 is a perspective view of an embodiment of the present invention incorporating player input conducive to an algorithm-based pay-out schedule.

Normally, the present invention will be implemented by the use of discrete tables such as those presented in FIGS. 5 and 6. However, there is also the option of computing pay-out schedules based on specified criteria as a function of the player-chosen jackpot. In other words, in such an embodiment, the pay-out schedules are determined based on a set of formulas rather than pre-computed pay-out schedules. In this way, the player has a continuum of choices within a range. FIG. 7 is a perspective view of such a device. In this example, the player may input any jackpot amount from $1,000 to $25,000 300, initiating a calculated pay-out schedule for use in that game. Such a table may be constructed for each game by iteratively adjusting each pay-out value to determine which combination most closely approaches a statistical overall target "take" (typically 1% to 3%, but it could be any amount). Since small variations in Jackpots cannot be accounted for with single-coin incremented pay-tables, such a scheme would normally be implemented with a computerized credit system capable of credit and debit increments of as little as $0.01. Most such implementations of the present invention will limit player input to, not only a "range," but to minimum incremental changes (such as $500). For example, a player could input (via a keypad 302, voice, touch screen 304 or other input device) jackpot amounts such as $5,500 or $8,000, but not $5,123 or $8,200. Such a device has the advantage of giving the player the feeling that he or she has increased control over the output of the game, but has the disadvantage of potentially slowing play down as players make their jackpot decisions. As such, this approach is not seen as a preferred embodiment. The strategy of writing a computer software program to accomplish the objective of a constant "take" no matter what jackpot is input (within a range) is well known to those skilled in the art. In essence, a probability of obtaining each winning combination of cards is assigned based on the objectively measurable probabilities adjusted for player-behavior resulting from higher or lower rewards for various alternatives as more fully described above. Such probabilities assigned by the programmer are stored in a register in the game computer memory and multiplied by the prize awarded for each such combination. The awards for each combination are incrementally increased and/or decreased and tested against the desired "take" (e.g. 2%). The program chooses a pay-out schedule so generated to use in a particular game by picking the pay-out schedule which comes closest to the target "take" and which has the closest to "optimal" prizes for intermediate pay-outs (e.g. "Two Pair," "Flush" etc.). The optimum will maximize the number of smaller prizes for lesser valued combination, as opposed to not paying anything for one or more lower valued card combinations. While high speed microcomputers make testing a large number of iteratively computed pay-out schedules technically feasible, the complexity, and thus cost, of constructing the software routines, as well as the additional computer hardware such as random access memory, required make this embodiment less advantageous than one which simply stores pre-determined pay-out scheduled and restricts the player to a relatively small finite number of such schedules from which to choose.

BEST MODE OF INVENTION

Video poker games are best suited to player-selected jackpots because the odds of achieving a particular hand given the initially-dealt cards is relatively evident being based on a finite set of cards in a (virtual) deck. This in not so with such games as slots where a virtual reel, as is well known to those skilled in the art, obscures the true probabilities of obtaining various combinations of symbols. In addition, the best embodiment of the display of candidate jackpots and associated pay-out schedules is a set of 3 to 6 identified by their highest ("Royal Flush") jackpots attainable only by betting the maximum number of credits. The more variations in jackpots and associated pay-schedules, the longer it takes for a player to choose between them. Therefore, most operators will prefer machines with three to six available pay-out schedules.

The display from which the player chooses the jackpot and associated pay-out schedule is optimally a video screen which displays each available jackpot with its associated pay-out schedule in sequence as the player presses a "Choose Jackpot" button. When the player decides on the play table he or she wishes to use, he or she simply leaves that table displayed while pressing the "Deal/Draw" button or touching the "Deal/Draw" icon on a touch screen. A less expensive machine may be constructed having printed jackpots and associated pay-out schedules and an indicator light, either behind or adjacent to each jackpot to indicate the currently selected jackpot. While this embodiment is less expensive to build, the displays may appear cluttered and may confuse or overwhelm the players, causing delay in play of the game. That is why a scrolling video display is chosen as the best mode for this invention.

While this invention has been described by examples of specific embodiments, it will be understood that it is not intended to limit the invention to the examples described. To the contrary, it is intended to cover all alternatives, modifications and equivalents as may be included within the spirit and scope of the invention as defined by the appended claims. It is clear that this invention is susceptible to numerous modifications and embodiments within the ability of those skilled in the art and without the exercise of inventive process. Accordingly, the invention should not be limited by the foregoing description, but should be defined only by the appended claims.

What is claimed is:

1. A gaming device comprising:

(a) means for accepting a wager from a player;

(b) means for displaying a multiplicity of alternative jackpots;

(c) means responsive to said player's input for selecting from among said multiplicity of said jackpots;

(d) means for indicating the jackpot selected by the player;

(e) means for storing a pay-out schedule of one or more winning outcomes associated with the selected jackpot in memory storage means;

(f) means for randomly selecting an outcome for the game;

(g) means for comparing the selected outcome with the payout schedule of winning outcomes to determine if the selected outcome is a winning outcome;

(h) means for awarding a prize for obtaining a winning outcome;

(i) means for determining said prize to be awarded including at least one algorithm which iteratively tests said resulting payout schedule against optimum characteristics stored in said memory storage means to choose the most optimal pay-out schedule.

2. A gaming device of the type including a processor adapted to randomly select for each game a winning and losing outcomes, means for accepting a wager to play the device and means for paying the player for obtaining designated winning outcome(s), said device comprising:

a payout display;

data storage means including data for each of a plurality of payout schedules, each schedule adapted to provide a house take within a preselected range and each schedule providing a preselected jackpot payout for at least one designated winning outcome;

a selector for the player to select prior to the play of any game from the data storage means a desired payout schedule, said schedule including said jackpot associated with the desired schedule displayed at the display;

means for rewarding the player for obtaining a winning outcome according to the payout schedule selected by the player.

3. The device of claim 2 wherein the gaming device is of the type for playing a video Poker game, said data storage means including for each payout schedule a jackpot payout for obtaining a Royal Flush.

4. The device of claim 3 including substantially the pay out schedules set forth in Table 1 below

TABLE 1

| | (Pay Outs per coin wagered) | | | | | |
|---|---|---|---|---|---|---|
| | 1 | 2 | 3 | 4 | 5 | 6 |
| Royal Flush(5 coins bet) | 800 | 1600 | 2400 | 3000 | 8000 | 20,000 |
| Royal Flush(less than 5 coins wagered) | 200 | 400 | 600 | 1000 | 2000 | no pay |
| Straight Flush | 50 | 50 | 50 | 50 | 50 | no pay |
| 4 of a Kind | 25 | 25 | 25 | 25 | 25 | no pay |
| Full House | 9 | 8 | 6 | 10 | 9 | no pay |
| Flush | 6 | 5 | 5 | 7 | 6 | no pay |
| Straight | 4 | 4 | 4 | 5 | 4 | no pay |
| 3 of a Kind | 3 | 3 | 3 | 3 | 3 | no pay |
| 2 Pair | 2 | 2 | 2 | 1 | 2 | no pay |
| Jacks or Better | 1 | 1 | 1 | 1 | no pay | no pay. |

5. The device of claim 3 including substantially the pay schedules set forth in Table 2 below

TABLE 2

| | (Pay outs per coin wagered) | | |
|---|---|---|---|
| | Pat Royal* | Sequential Royal* | Pat Sequential* Royal |
| Royal Flush (5 coins bet) | 8,000* | 80,000* | 800,000* |
| Royal Flush (less than 5 coins wagered) | 200 | 200 | 200 |
| Straight Flush | 50 | 50 | 50 |
| 4 of a Kind | 25 | 25 | 25 |
| Full House | 8 | 8 | 8 |

TABLE 2-continued

| | (Pay outs per coin wagered) | | |
|---|---|---|---|
| | Pat Royal* | Sequential Royal* | Pat Sequential* Royal |
| Flush | 5 | 5 | 5 |
| Straight | 4 | 4 | 4 |
| 3 of a Kind | 3 | 3 | 3 |
| 2 Pair | 2 | 2 | 2 |
| Jacks or Better | 1 | 1 | 1. |

6. A method for playing a casino game providing player selected pay out schedules comprising:

providing a game which provides for each play of the game a plurality of randomly selected outcomes, certain of said outcomes designated as winning outcomes and at least one of said winning outcomes designated as a jackpot outcome;

the player making a wager to play each game;

the player, prior to playing a game, opting to select from a plurality of provided pay out schedules, each schedule providing at least one unique winning outcome payoff and each schedule adapted to provide the casino with substantially the same house take; and playing the game to obtain an outcome and if the outcome is a winning outcome providing a pay out to the player based upon the player selected pay out schedule.

7. The method of claim 6 including providing the game as a video Poker-type game and designating the Royal Flush as a jackpot outcome.

8. The method of claim 7 including the player selecting from at least a plurality of the pay out schedules set forth in Table 1

TABLE 1

| | (Pay outs per coin wagered) | | | | | |
|---|---|---|---|---|---|---|
| | 1 | 2 | 3 | 4 | 5 | 6 |
| Royal Flush (max 5 coins bet) | 800 | 1600 | 2400 | 3000 | 8,000 | 20,000 |
| Royal Flush(less than 5 coins wagered) | 200 | 400 | 600 | 1000 | 2000 | no pay |
| Straight Flush | 50 | 50 | 50 | 50 | 50 | no pay |
| 4 of a Kind | 25 | 25 | 25 | 25 | 25 | no pay |
| Full House | 9 | 8 | 6 | 10 | 9 | no pay |
| Flush | 6 | 5 | 5 | 7 | 6 | no pay |
| Straight | 4 | 4 | 4 | 5 | 4 | no pay |
| 3 of a Kind | 3 | 3 | 3 | 3 | 3 | no pay |
| 2 Pair | 2 | 2 | 2 | 1 | 2 | no pay |
| Jacks or Better | 1 | 1 | 1 | 1 | no pay | no pay. |

9. The method of claim claim 7 including the player selecting from at least a plurality of the pay out schedules set forth in Table 2

TABLE 2

| | (Pay outs per coin wagered) | | |
|---|---|---|---|
| | Pat Royal* | Sequential Royal* | Pat Sequential* Royal |
| Royal Flush (max 5 coins bet) | 8,000 | 80,000 | 800,000 |
| Royal Flush (less 5 coins bet) | 4,000 | 4000 | 4000 |
| Straight Flush | 50 | 50 | 50 |
| 4 of a Kind | 25 | 25 | 25 |
| Full House | 8 | 8 | 8 |
| Flush | 5 | 5 | 5 |
| Straight | 4 | 4 | 4 |
| 3 of a Kind | 3 | 3 | 3 |
| 2 Pair | 2 | 2 | 2 |
| Jacks or Better | 1 | 1 | 1. |

* * * * *